United States Patent [19]

Baumann

[11] 4,409,693

[45] Oct. 18, 1983

[54] BUBBLE BATH DEVICE

[76] Inventor: Peter Baumann, Schulstr. 9, CH-8280 Kreuzlingen/TG, Switzerland

[21] Appl. No.: 370,184

[22] Filed: Apr. 21, 1982

[30] Foreign Application Priority Data

Apr. 23, 1981 [DE] Fed. Rep. of Germany ..... 3116199

[51] Int. Cl.[3] ..... A47K 3/00

[52] U.S. Cl. ..... 4/543; 4/559; 261/122

[58] Field of Search ..... 4/541–544, 4/488–492, 530, 559, 580, 583; 128/66; 261/122, 124

[56] References Cited

U.S. PATENT DOCUMENTS

| | | | |
|---|---|---|---|
| 1,642,051 | 9/1927 | Wall | 4/542 X |
| 3,086,517 | 7/1961 | Dunkle | 128/66 |
| 3,870,040 | 3/1975 | Klages | 128/66 X |
| 4,048,266 | 9/1977 | Baumann | 261/122 X |

FOREIGN PATENT DOCUMENTS

| | | | |
|---|---|---|---|
| 2732747 | 2/1979 | Fed. Rep. of Germany | 128/66 |
| 2912006 | 10/1980 | Fed. Rep. of Germany | 4/543 |
| 2931182 | 2/1981 | Fed. Rep. of Germany | 4/542 |

*Primary Examiner*—Stephen Marcus
*Assistant Examiner*—Kenneth S. Putnam

[57] ABSTRACT

The invention relates to a bubble bath device with varyingly large and separately operable air exit holes for large and small bubble production. The bubble bath device has at least one device body which in turn contains at least one air chamber. The air exit holes of the air chamber of chambers are provided for at least one treatment type. In addition, the device comprises tubular conduits, particularly hoses, which also have air exit holes, constructed for at least one further treatment type.

10 Claims, 6 Drawing Figures

BUBBLE BATH DEVICE

BACKGROUND OF THE INVENTION

1. Field of the Invention

The invention relates to a bubble bath device with varyingly large and separately operable air exit holes, the device having at least one body with air chambers.

2. Prior Art

Bubble bath devices for large and small bubble production are known, whose bodies comprise a box-like part with an inner area subdivided into a plurality of chambers. Problems can be encountered in the production of such a device because at least some of the chambers must be separately supplied with air for large bubble production on the one hand and others must be supplied with air for small bubble production. The chambers of each must be sealed in air-tight manner with respect to one another, because otherwise it would not be possible to separately supply or inject air into the corresponding air chambers for the bubble treatment associated therewith. The partitions separating the individual air chambers of such a device body frequently form an extensive labyrinth, which can only be made pressure-tight with considerable effort and expense.

SUMMARY OF THE INVENTION

The object of the invention is to provide a bubble bath device for producing large and small bubbles, which can be produced more simply and therefore less expensively, avoiding the sealing problems of known devices, and at the same time, which has a multiplicity of uses.

According to the invention this object is achieved in that the device comprises air chambers, having air exit holes for at least one treatment type, and tubular conduits, having air exit holes for at least one further treatment type.

Production of different types of bubbles can be achieved by allocating one type of bubble production to the tubular conduits on one hand, which are preferably constructed as flexible hoses, and one type of bubble production to the air chambers in the device bodies on the other hand. The resulting bubble bath device has a multiplicity of uses, without making its manufacture more complicated. Compared with the prior art, the invention has the advantages of ensuring the production of a bubble bath device for large and small bubble production in a relatively simple manner. It is possible to rapidly and simply check the pressure tightness of the device from the outside following manufacture. As a result manufacturing costs can be considerably reduced. It is possible to use simpler tools, because partitions for separating the air chambers are no longer required within the device body.

In a preferred embodiment a bubble bath device according to the invention has a plurality of longitudinally disposed bodies extending over the entire width of the device. The bodies can be subdivided into juxtaposed, separate chambers. The bodies can also comprises individual parts of the device or the device body, which are juxtaposed and interconnected, and in each case have only a single chamber. The device bodies are preferably also supports for tubular conduits having additional air exit holes. These flexible conduits can be held in slots provided in the device bodies. It is particularly advantageous if the air chambers of the individual device bodies are kept separate from one another and are free from any partitions dividing them. All the sealing points or joints of the chambers are arranged in such a way that they can be sealed along their outside boundaries. Perimeter sealing leads to further advantages, particularly when carrying out sealing inspections because untight unsealed points can be immediately detected, which would not be the case if the chambers had internal partitions with common seals or joints. Leaks in such partitions are very difficult to detect. The device bodies are preferably formed from thermoplastic materials.

The holes of the individual device bodies are preferably arranged in rows of hollowed out holes which, particularly in the case of holes for fine bubble production, preferably run at right angles to the rows of larger holes in the tubular conduits. Even though the arrangement is simple, good surface distribution of the fine air bubbles is ensured. The air exit holes in the device bodies are preferably conical. This makes it possible to influence the separation or detachment of small air bubbles from the edge of the hole. Furthermore, through a suitable alignment of the conicity, risks of obstruction or clogging can be avoided.

Each device body preferably has at least one frontal charging opening for the bubble foam. These charging openings can be constructed as connecting sockets for connecting pieces, in order to interconnect, in air-conducting manner, a plurality of device bodies. It is also possible to provide a tubular conduit along a particular slot of the body, the tubular conduit having at least one opening which communicates with a corresponding opening in the chamber wall in the vicinity of the slot. In this way a plurality of device bodies can be interconnected by means of a continuous conduit having branch openings leading into the chambers. At least the bottom of the device body may be downwardly curved to reduce the volume of the chambers and decrease buoyancy. The individual device parts of a composite device body can also be flexibly interconnected, so that the device adapts to the curved shape of the bottom of a bathtub. Use in narrow bathtubs can also be made easier if the lateral edges of a device body are rounded or tapered at the bottom.

Further advantages of the invention will become apparent from the following description and claims.

BRIEF DESCRIPTION OF THE DRAWINGS

The invention is illustrated by means of several embodiments shown in the drawings, wherein.

DETAILED DESCRIPTION OF THE PREFERRED EMBODIMENTS

The device bodies shown in FIGS. 1 to 5 and described hereinafter are preferably capable of being interconnected to form parts of a composite bubble bath device having a configuration such as that shown in FIG. 6.

Figure 1:
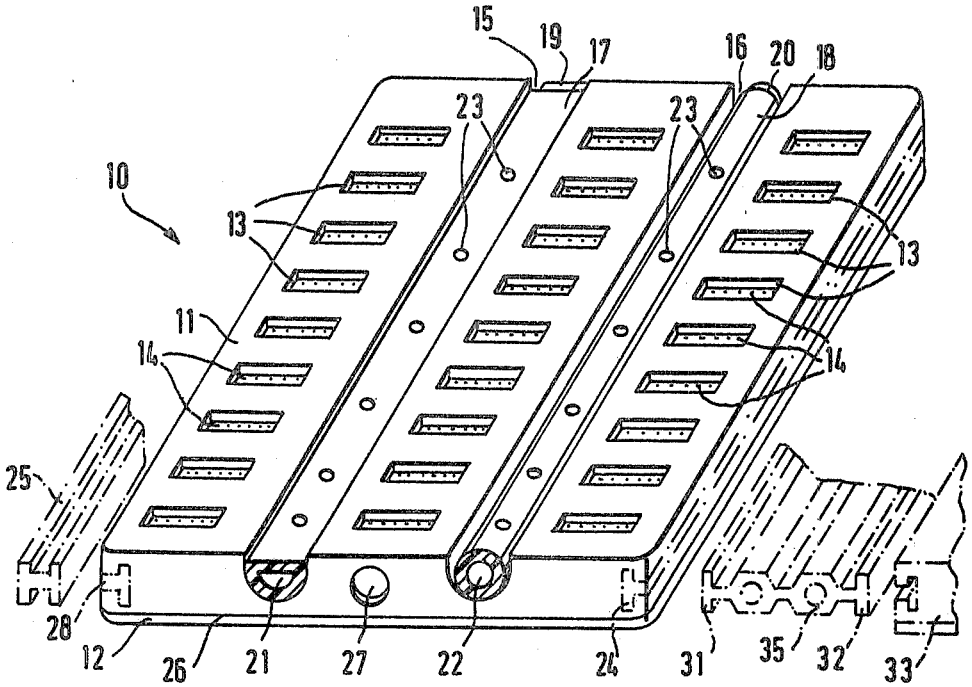
FIG. 1 is a perspective view of a device body with small bubble openings and hoses having large bubble openings inserted therein, as well as a frontal charging opening for the body.

With reference to FIG. 1, a device body part 10 initially comprises an inner hollow upper part 11 and a bottom part 12. These two parts are interconnected in pressure-tight manner along a perimeter joint 26. The bottom part 12 is preferably constructed as a flat, level part. However, it can also be profiled in order to keep the air volume of the device low, and consequently keep its buoyancy low. The upper part 11 contains recesses 13 with bubble openings 14 formed in a conventional manner. In the present embodiment the openings have a small diameter and are intended for fine or small bubble production.

Upper part 11 also has slots 15, 16 in which hoses 17, 18 are inserted. As a result of adapting the shape of the walls of slots 15, 16, hoses 17, 18 can be snapped or pressed into slots 15, 16 of upper part 11. One side of each of hoses 17, 18 can be sealed by closure members or caps 19, 20, while bubble foam is supplied to their opposite hose ends 21, 22. The caps 19, 20 of a central device body part can also be provided with an attachment hook. In the present embodiment hoses 17, 18 are provided with large diameter bubble openings 23 for producing large or massage bubbles. However, it is also possible to provide large bubble openings in the recesses 13 of upper part 11 and small bubble openings in hoses 17, 18. At the front, device part 10 is provided with a charging opening 27, through which the bubble foam is supplied to part 10 or the corresponding air chamber. Compared with known devices or device parts, the construction of the present device part has the advantage that there is no need to subdivide the chambers. However, it is also possible to provide separate chambers. If desired, the latter can be charged with bubble foam at different pressure levels or can have varyingly large air exit holes. Preferably, the air chambers are constructed in such a way that they need only be sealed around the outside i.e., as in the embodiment of FIG. 1. The production of a different bubble type or the connection of separate bubble production areas is made possible by means of hoses 17, 18, the latter constituting an independent pressure system hermetically sealed with respect to the device body 10.

The hoses can be constructed either with a round cross-section, as is hose 17 in FIG. 1, or with a flattened cross-section, as is hose 18. In either event, as is particularly clear in FIG. 5, the cross-section of each hose is substantially smaller than the cross-section of any of the chambers formed between top and bottom arts 11, 12.

A plurality of device parts 10, 33 (FIG. 1) can be interconnected by and supplemented by means of a further device part 35 used e.g., for large bubble production in the back area, to provide a device body representing the complete width of a bubble bath device. An undercut slot 24 is provided on the device part 10 for receiving a shoulder 31 of device part 35 which can be slid or snapped therein. Alternatively, device parts 10 and 35 can be formed integrally. Device part 35, which also has bubble production openings, is slid or snapped into a corresponding slot on device body 33. It is also possible to provide on the other side of device part 10 a further device part (not shown in the drawing) with the aid of a connecting part 25 and a slot 28, which is also undercut in the presently preferred embodiment.

Figure 2:
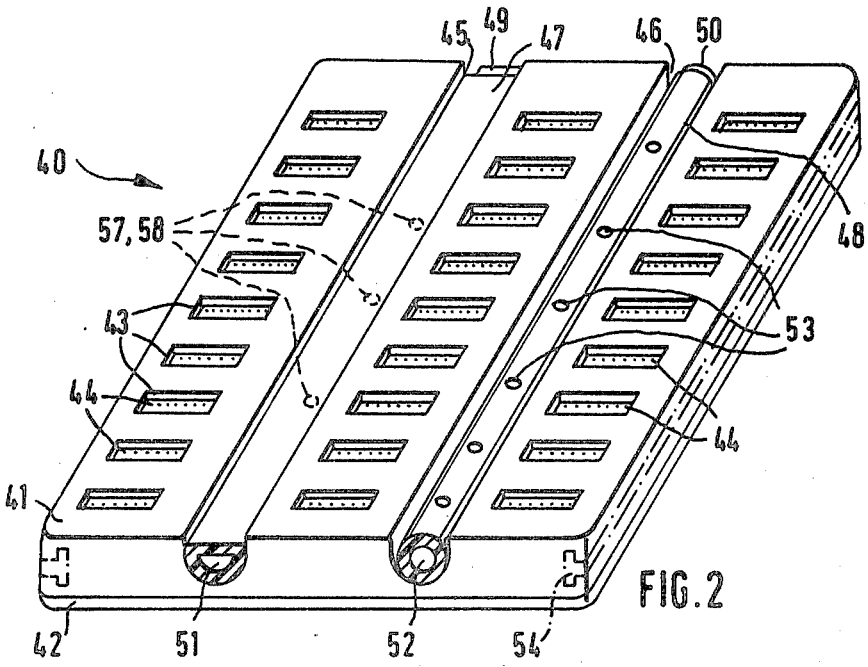
FIG. 2 is a perspective view of a device body, but without a frontal charging opening, the latter being replaced by an air-charging hose inserted in said body.

A further embodiment of another device part 40 is shown in FIG. 2. This device part is also provided with recesses 43 containing small cross-section bubble openings 44. One slot 46 contains a hose 48, which is fixed in the slot. Hose 48 is provided a cap 50 at one end, and is supplied with bubble foam by means of a hose part 52 at the other end. Hose 48 is provided with large diameter bubble openings 53 for purposes of massage bubble production. A further hose 47 is fixed, e.g., by snapping or sticking into a further slot 45. The openings 57 of hose 47 correspond with other openings 58 in the device body 40. Bubble foam is supplied to device part 40 by hose 47, whose end is sealed by a cap 49. This arrangement makes it unnecessary to have a separate charging opening at the front of device part 40, as in the embodiment of FIG. 1.

Device part 40 also comprises an upper part 41 and a bottom part 42, which are interconnected in pressure-tight manner along a joint 56. Device part 40 also has only a single chamber formed by upper part 41 and bottom part 42, and is supplied with the bubble foam by means of a hose end 51 on hose 47. The other pressure area is formed by hose 48 with bubble openings 53 of a different diameter than holes 44.

Device part 40 can also be provided with at least one slot 54 for connection to other device parts.

Figure 3:
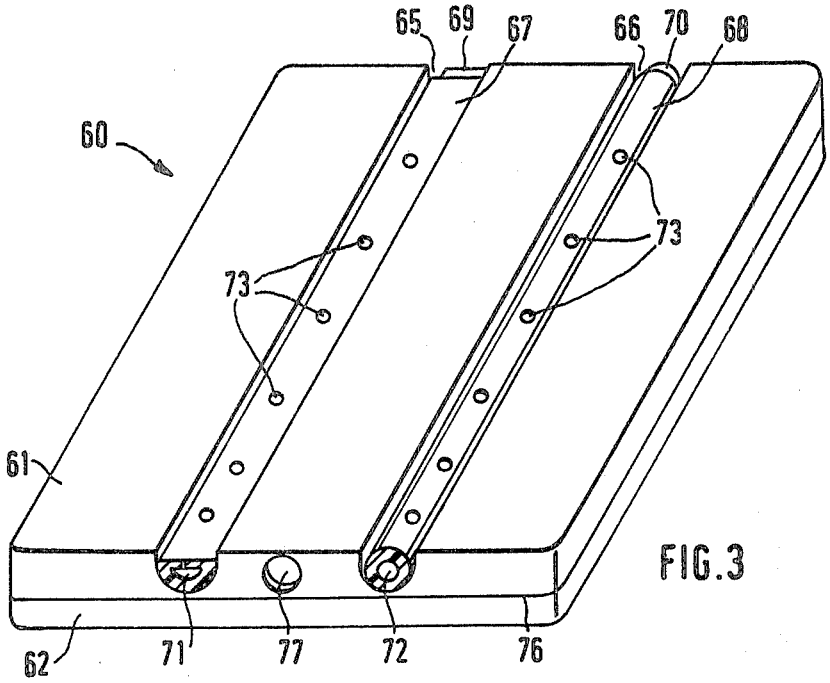
FIG. 3 is a perspective view of a device body part usable on both sides, in the position of use for large bubble production.
Figure 4:
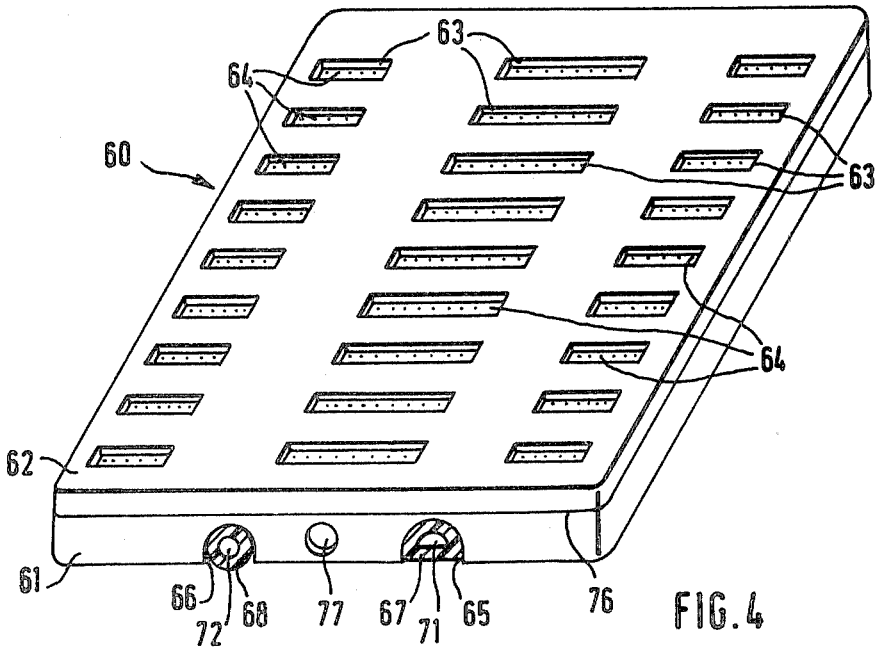
FIG. 4 is a perspective view of the device body part shown in FIG. 3, but in the position of use for small bubble production.

The invention also makes it possible to produce a bubble bath device which can be used on either side. Such an embodiment is illustrated in FIGS. 3 and 4. A device part 60 comprises an inner hollow upper part 61 and an inner hollow bottom part 62, interconnected in pressure-tight manner along a joint 76. Slots 65, 66 are provided in upper part 61. Hoses 67, 68 are fixed in slots 65, 66 and are each provided at one end thereof with caps 69, 70. In this embodiment hoses 67, 68 have relatively large bubble openings 73 and are used for producing massage bubbles when a bubble foam is supplied to hose ends 71, 72.

Bottom part 62 (FIG. 4) has recesses 63 with, in the present embodiment, relatively small bubble openings for the production of fine bubbles. When bubble foam is supplied by means of a charging opening 77 of device part 60, the foam passes out of the bubble openings 64. The box-shaped inner area of device part 60 can also be very easily sealed in pressure-tight manner, because it is only necessary to close joint 76, which can be checked from the outside.

Figure 5:
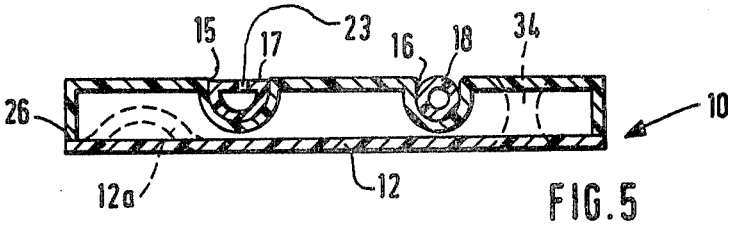
FIG. 5 is a cross-section through the device body part of FIG. 1 with flooding ducts for reducing its air volume.
Figure 6:
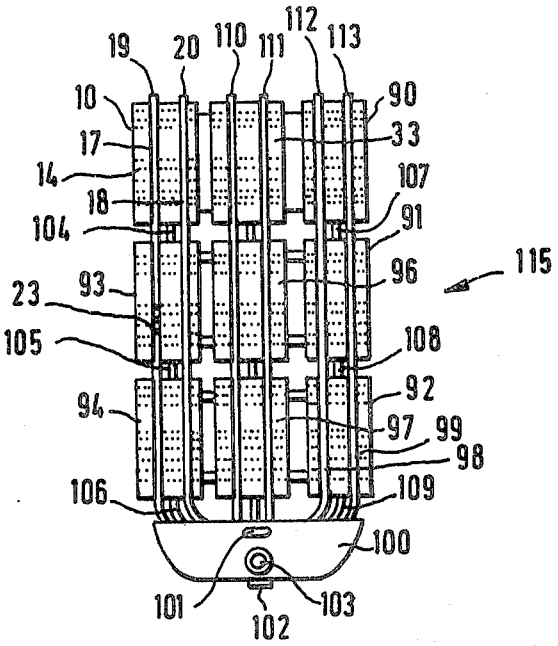
FIG. 6 is a diagrammatic plan view of a bubble bath device with an air distributor comprising a plurality of device body parts.

The device part 10 shown in FIG. 1 can have a cross-sectional configuration as shown in FIG. 5. Device part 10 can have flooding ducts 34 for reducing the air volume of the device. Ducts 34 constitute connections between the top and bottom of device part 10. A further or parallel measure provides for the use of a corrugated bottom part **12*a* (FIG. 5). As a result of such inwardly directed curvatures, the volume of the device part 10** is reduced, and consequently, its buoyancy is reduced.

A bubble bath device 115 (FIG. 6) can be produced from the aforementioned device parts and device bodies with the associated hoses. Such a device comprises e.g., device parts 10, 90, 91, 92, 93, and 94, as well as device parts 33, 96, 97 arranged in the center of the device, which can also serve as connecting parts between the outer device parts. Hoses 17, 18, 98, and 99 are fixed in corresponding slots of the external device parts 10, 93, 94, as well as 90, 91, 92. In the present embodiment these hoses are closed at their free ends by caps 19, 20, 112, 113, while their opposite ends are connected to an air distributor 100. Hoses 17, 18, 98, 99 can have, e.g., bubble openings 23 for producing massage bubbles. In this case device parts 10, 93, 94, 90, 91, 92 have small diameter bubble openings 14 for producing small bubbles. However, the individual device parts can also be constructed in the manner described hereinbefore relative to FIGS. 2 to 4. This means that the bubble bath device 115 (FIG. 6) can be constructed in accordance with FIGS. 3 and 4 as a device usable on both sides. The inner areas of device parts 10, 93, 94 are interconnected by means of connecting pieces 104, 105, 106 and are connected to the air distributor 100, while the inner areas of device parts 90, 91, 92 are interconnected by means of connecting pieces 107, 108, 109 and are also connected to air distributor 100. The tubular connecting pieces are preferably flexible. If the hoses 17, 98 are used in the manner described in FIG. 2, there is need for connecting pieces 104 to 109.

Device parts 33, 96, 97 can be constructed in the same way as the external device parts, i.e., with inserted hoses, sealed at their free ends by caps 110, 111. However, if the hoselike inner areas are already incorporated into device parts 30, 96, 97, it is necessary to have separate hose connections between the individual device parts 33, 96, 97 and the air distributor 100.

Transverse pressure connections can also be provided. For example, the device parts 93 may be interconnected by means of hose couplings or plug-in connections. The connections may continue in the same way from device part 96 to device part 91. This also applies with regard to the other device parts.

Air distributor 100 is provided with a separate opening 102 for draining water from bubble bath device 115. If the bubble bath device is raised to such a level that the air distributor 100 is at the bottom, water can run out of opening 102, so that the device is emptied. A special position of the valve plug 101, which connects opening 102 with one or more of the hoses or hose connections leading to the device bodies, can speed up the emptying process. Opening 102 is positioned in air distributor 100 in such a way that water running out of the bubble bath device 115 cannot flow out of a charging opening 103 at a somewhat higher level and which serves as the connection of the bubble foam supply hose.

I claim:

1. A bubble bath device, comprising:

at least one device body defining a substantially boxlike continuous air chamber having at least one substantially flat surface, the surface having a plurality of rows of air exit holes of a first, relatively smaller size for producing a first type of bubble treatment; and, tubular conduits, each having a small cross-section relative to the chamber and each having air exit holes of a second, relatively larger size for producing a second type of bubble treatment.

2. The bubble bath device of claim 1, comprising a plurality of the device bodies.

3. The bubble bath device of claims 1 or 2, wherein each of the tubular conduits is supported by at least one of the device bodies.

4. The bubble bath device of claim 3, wherein each of the device bodies comprises at least one slot for receiving one of the tubular conduits.

5. The bubble bath device of claim 1, wherein the rows of the first size exit holes run perpendicularly to the tubular conduits.

6. The bubble bath device of claims 1 or 5, wherein the exit holes of the first size are conically shaped.

7. The bubble bath device of claim 1, wherein at least one device body comprises a frontal charging opening, through which bubble foam is supplied to the air chamber.

8. The bubble bath device of claims 1 or 2, wherein each of the device bodies comprises at least two slots, one of the at least two slots for receiving one of the tubular conduits having the exit holes of the second size, and the other of the at least two slots for receiving a tubular conduit through which bubble foam is supplied to the air chamber, the bubble foam supply conduit and the corresponding slot of the device body having aligned openings through which the bubble foam flows.

9. The bubble bath device of claims 1 or 2, wherein each of the device bodies has a bottom part which is curved inwardly to reduce the volume of each body.

10. The bubble bath device of claims 1 or 2, further comprising means for draining water from each of the device bodies.

* * * * *